US007258251B2

(12) United States Patent
Johnson

(10) Patent No.: US 7,258,251 B2
(45) Date of Patent: Aug. 21, 2007

(54) MULTI-CHAMBERED DISPENSING CONTAINER

(76) Inventor: Juan Perez Johnson, 21829 Richton Rd., Matteson, IL (US) 60443

( * ) Notice: Subject to any disclaimer, the term of this patent is extended or adjusted under 35 U.S.C. 154(b) by 472 days.

(21) Appl. No.: 10/924,781

(22) Filed: Aug. 25, 2004

(65) Prior Publication Data

US 2006/0043047 A1 Mar. 2, 2006

(51) Int. Cl.
*B67D 5/56* (2006.01)

(52) U.S. Cl. ..... 222/129; 215/6

(58) Field of Classification Search ..... 222/129, 222/480, 142.1, 142.7, 145.1, 145.3, 129.1, 222/138; 220/522–526, 505, 509, 516, 527, 220/601; 215/378, 385, 6
See application file for complete search history.

(56) References Cited

U.S. PATENT DOCUMENTS 3,876,112 A * 4/1975 Kramer ..... 222/132
4,148,417 A * 4/1979 Simmons ..... 222/94
D323,108 S * 1/1992 Green ..... D9/741
D404,972 S * 2/1999 Rodgers, Jr. ..... D7/598
5,881,918 A * 3/1999 Eichler ..... 222/135
5,954,231 A * 9/1999 Durliat et al. ..... 222/1
6,138,853 A * 10/2000 Frechette ..... 220/212.5
D471,819 S * 3/2003 Paul et al. ..... D9/524
6,732,888 B1 * 5/2004 Smiley et al. ..... 222/485
D517,866 S * 3/2006 Burks ..... D7/590

* cited by examiner

*Primary Examiner*—Lien M. Ngo
(74) *Attorney, Agent, or Firm*—Pradip K. Sahu

(57) ABSTRACT

A multi-chambered dispensing container which has a unique means for seating the cap portion of the container to the bottle portion of the container. The cap portion can be attached to the bottle portion such that the contents of one chamber of the container do not leak into another chamber. The contents of the container can be dispensed independently or at the same time. The container may also be refilled using alternate refill holes located in the bottle portion of the container.

13 Claims, 2 Drawing Sheets

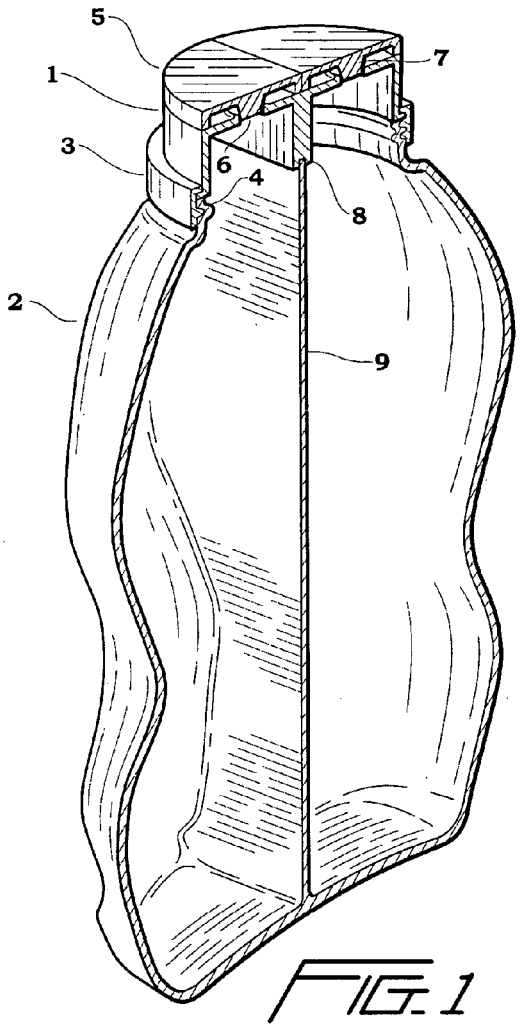
FIG. 1
FIG. 2
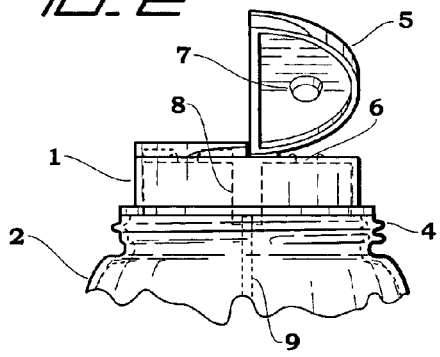
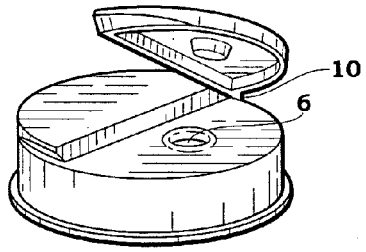
FIG. 3
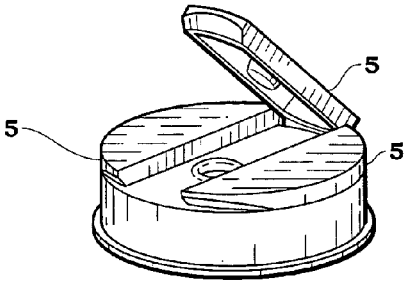
FIG. 4
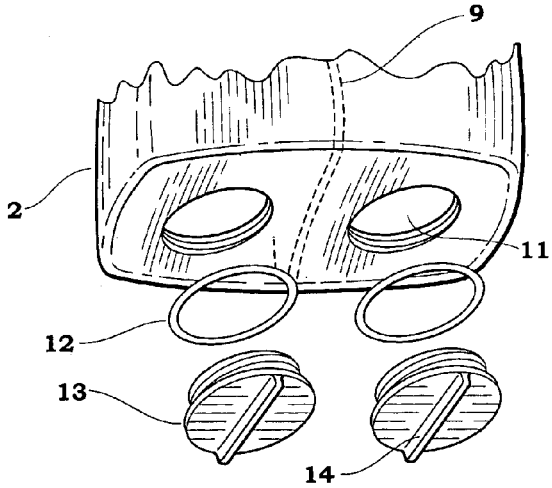
FIG. 5

MULTI-CHAMBERED DISPENSING CONTAINER

FIELD OF THE INVENTION

This invention relates to containers, and more particularly to a multi-chambered container which can be used to store multiple products and in which each product may be dispensed independently or at the same time.

BACKGROUND OF THE INVENTION

There are numerous types of products that are used together, such as mustard and ketchup. These types of products are normally provided to consumers in separate containers. In many cases, consumers would like to keep such related products together so that they are readily available to use at the same time.

Consumers may also use different varieties of the same product, such as salad dressings. Products such as these are also normally provided to consumers in separate containers. In many instances consumers would like to purchase multiple types of such products without having to obtain large quantities of each variety. They also may like to store such products conveniently together so that they are ready to use at the same time.

BRIEF SUMMARY OF THE INVENTION

One object of this invention is to provide a means for storing and dispensing at least two substances, such as ketchup and mustard; salt and pepper; peanut butter and jelly; shampoo and conditioner; ketchup, mustard and mayonnaise; or ketchup, mustard and relish, among other combinations. This invention would be especially appealing to those in the restaurant services industry where convenience, space limitations and re-usability are of great concern. This invention would also appeal to consumers of household products, who may share the same concerns.

One difficulty that one embodiment of this invention overcomes is the problem of screwing on the cap portion to the bottle portion of the dispenser. One embodiment of this invention incorporates a unique seating mechanism whereby the user presses the cap portion down onto the main dispensing opening of the bottle portion. The user may then seal the cap portion to the bottle portion by screwing the coupling ring piece of the cap portion to the bottle portion. The seal between the cap portion and the bottle portion (as well as for all other openings of the bottle and cap) may be made increasingly air-tight or water-tight by incorporating gaskets or similar pliable materials. The gaskets may be affixed to the cap portion of the dispenser or to the bottle portion of the dispenser.

One other difficulty that one embodiment of this invention overcomes is the problem associated with refilling containers. Although the container can be refilled through the dispensing holes or the main dispensing opening of the bottle, it may be more desirable to refill the bottle through alternate openings located at the bottom of the container. These refill openings may be made larger than the main dispensing holes, so it would be easier to refill the container in a shorter amount of time and with less mess.

One embodiment of this invention utilizes an inverted bottle. That is, the bottle portion is physically above the cap portion, so gravity will work to keep the contents of the bottle closer to the cap portion. Any air pockets will rise away from the cap portion. This embodiment would require the cap portion to be of sufficient size and/or weight relative to the bottle portion to prevent the bottle from tipping over. This configuration would result in an added convenience to the end user, because considerably less shaking would be necessary to dispense the contents of the bottle.

Another embodiment of this invention utilizes a cap portion that is permanently affixed to the bottle portion. A container with a permanently affixed cap may be more easily manufactured, and it would result in more convenience and less mess for the consumer. The container with a permanently affixed cap portion may be used in conjunction with the bottle portion incorporating refill openings. This configuration will result in reusability of the container.

Another embodiment of this invention utilizes a cap portion that snaps onto the bottle portion without the need of a coupling ring. This configuration would be beneficial to consumers who would like to save time in closing the container.

One other embodiment of the invention utilizes dispensing pumps instead of lids to dispense the contents of each chamber of the container. This type of dispensing pump is similar to those used in liquid soap containers. However, with the claimed invention more than one type of cleansing substance, such as liquid anti-bacterial soap and disinfectant gel, can be stored and dispensed using the same container.

The bottle portion of the invention may be made out of a non-squeezable substance, such as glass. In such embodiments, the dispensing holes of the cap portion should be made rather large to allow the contents to be released by gravity alone. However, if the bottle portion is made out of a squeezable substance, such as plastic, the dispensing openings of the cap may be made rather small. The pressure that the consumer creates by squeezing the container would create sufficient force to release the contents located therein.

BRIEF DESCRIPTION OF THE DRAWING

The accompanying drawings are a part of this specification. The drawings illustrate optional embodiments of the invention and help to explain certain principles. The drawings are not intended to limit the scope of the invention in any way.

FIG. 1 illustrates a sectional view of one embodiment of the container.

FIG. 2 illustrates one embodiment of the cap portion of the container resting on the bottle portion, with one of the two lids open.

FIG. 3 illustrates a perspective view of one embodiment of the cap portion of the container, with one of the two lids open.

FIG. 4 illustrates a perspective view of one embodiment of the cap portion of the container, with one of the three lids open.

FIG. 5 illustrates a bottom perspective view of one embodiment of the bottom of the bottle portion of the container, displaying two refill openings.

DETAILED DESCRIPTION OF THE INVENTION

Figure 6:
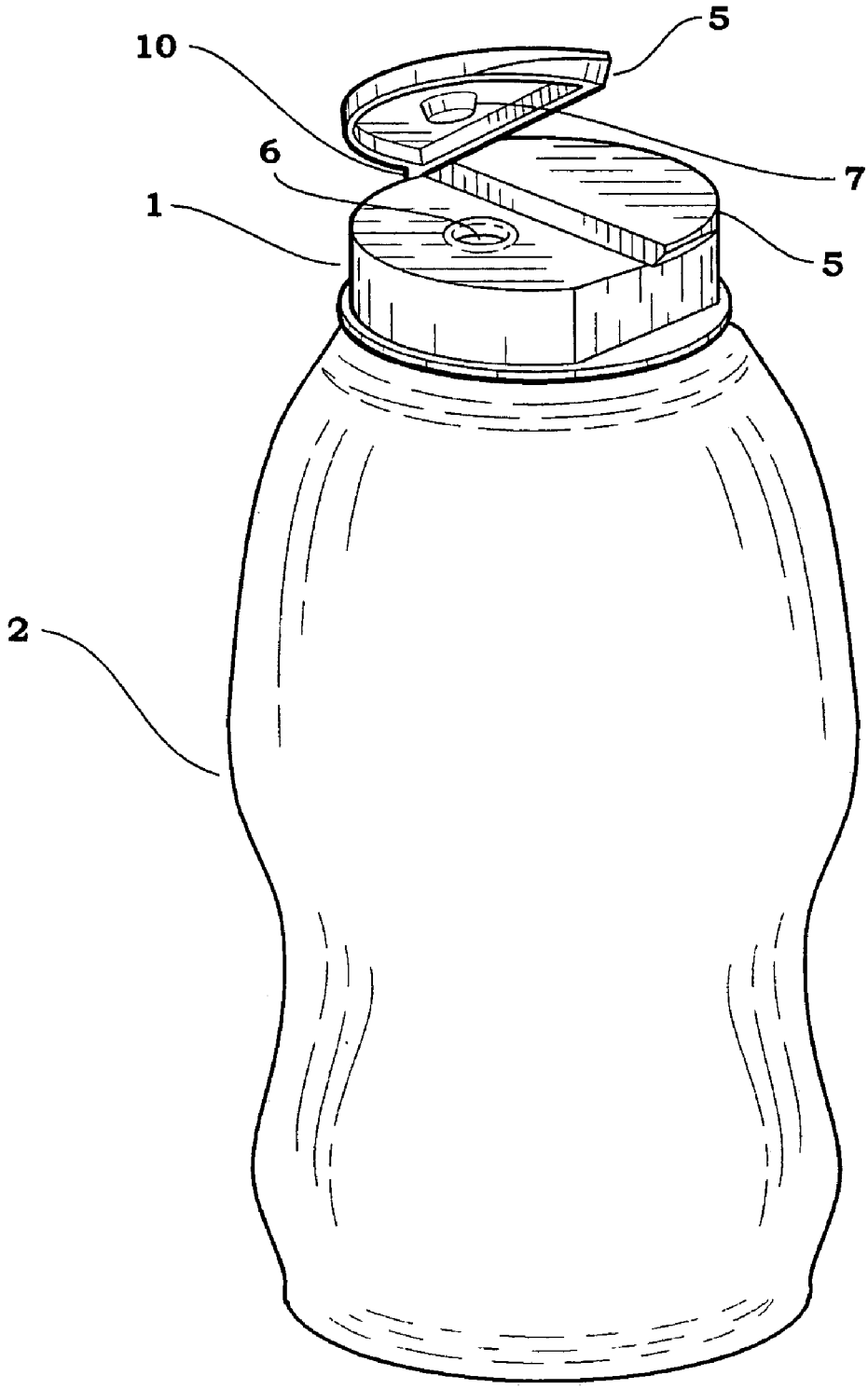
FIG. 6 illustrates a perspective view of one embodiment of the container.

Various preferred embodiments are described in the following detailed description. However, the invention is not limited to its preferred embodiments. The invention includes various alternatives, modifications and equivalents within its spirit and scope as are apparent to the skilled artisan.

FIG. 1 depicts a sectional view of one embodiment showing the container divided in half. The container in FIG. 1 incorporates two chambers, although other embodiments may contain more chambers. The cap portion (1) is removably affixed to the bottle portion (2) by means of a female coupling ring (3) screwably attached to a threaded portion (4) on the exterior of the bottle portion (2). The independently operative lid portions (5) are hingedly affixed to the cap portion (1). The cap portion (1) has dispensing holes (6) that communicate between the interior and exterior of the container. The lid portions (5) each contain dispensing hole plugs (7) for closing the dispensing holes (6) by creating an air-tight or water-tight seal. The cap portion (1) also has a seating means (8) that divides the interior of the cap portion (1) into two compartments in this particular embodiment. The seating means (8) is affixed to the dividing wall (9) to create an air-tight or water-tight seal such that the contents of one compartment can not leak into another compartment.

FIG. 2 shows one embodiment of the cap portion (1) resting on the top part of the bottle portion (2) without the female coupling ring (3). The broken lines represent the interior aspects of the container, including the dividing wall (9), the seating means (8) and the dispensing holes (6). FIG. 2 also depicts the threaded portion of the bottle (4). One of the lid portions (5) is in a closed position, while the other is in an opened position.

FIG. 3 depicts one embodiment of the cap portion (1), showing the hinge means (10). One of the lid portions is in the closed position, while the other is in the open position.

FIG. 4 depicts another embodiment of the cap portion, with three lid portions. The middle lid portion is in the open position, and the other two lid portions are in the closed position.

FIG. 5 shows an alternative bottom for the container. The alternative bottom comprises refill holes (11) corresponding to the number of chambers within the container. The refill holes (11) may be closed by means of refill plugs (13) that may be screwed into the refill holes (11). Gaskets (12) may be used to increase the air-tightness or water-tightness of the resulting seal. An elevated ridge (14) may be used on the refill plugs (13) to aid in removing or attaching the refill plugs (13). The refill plugs (13) may be inset in the bottom of the container to reduce the likelihood of the container tipping over if used in the upright position.

FIG. 6 depicts one embodiment of the invention in which the cap portion (1) is permanently affixed to the bottle portion (2) without the use of a female coupling ring or a threaded portion on the bottle portion.

The invention claimed is:

1. A container comprising a) a cap portion; the cap portion further comprising an internal side and an external side; the cap portion further comprising at least two lid portions located on the external side of the cap portion; each lid portion being independently operative; each lid portion affixed to the cap portion by a corresponding hinge means; each lid portion capable of being in an open lid position and a closed lid position;

the cap portion further comprising dispensing holes corresponding to each lid portion; the dispensing holes communicating between the external side of the cap portion and the internal side of the cap portion;

each lid portion further comprising a dispensing hole plug; each dispensing hole plug capable of sealing the corresponding dispensing hole when the corresponding lid portion is in the closed lid position;

the cap portion further comprising a means for seating the cap portion onto a bottle portion; the means for seating the cap portion onto the bottle portion dividing the internal side of the cap portion into divisions corresponding to each lid portion;

b) the bottle portion further comprising an internal bottle portion and an external bottle portion; the bottle portion further comprising an internally located dividing wall; the internally located dividing wall separating the bottle into chambers corresponding to each division of the cap portion; and c) means for securing the cap portion to the bottle portion.

2. The container of claim 1 wherein the means for securing the cap portion to the bottle portion comprises a female coupling ring screwably affixed to a male threaded portion located on the external bottle portion.

3. The container of claim 1 wherein the cap portion is permanently affixed to the bottle portion.

4. The container of claim 1 further comprising a refilling means.

5. The container of claim 1 further comprising a refilling means; the refilling means comprising refill holes corresponding to the number of chambers; the refilling means further comprising refill plugs corresponding to each refill hole; each refill plug further comprising an internal refill plug portion and an external refill plug portion; each refill plug further comprising an elevated ridge located on the external refill plug portion; each refill plug capable of being screwed into the corresponding refill hole using the elevated ridges.

6. The container of claim 1 further comprising a refilling means; the refilling means comprising refill holes corresponding to the number of chambers; the refilling means further comprising refill plugs corresponding to each refill hole; each refill plug further comprising an internal refill plug portion and an external refill plug portion; each refill plug further comprising an elevated ridge located on the external refill plug portion; each refill plug capable of being screwed into the corresponding refill hole using the elevated ridges; the refilling means further comprising gaskets placed between each refill plug and the bottle portion.

7. The container of claim 1 wherein the means for securing the cap portion to the bottle portion comprises a female coupling ring screwably affixed to a male threaded portion located on the external bottle portion; the container further comprising a refilling means; the refilling means comprising refill holes corresponding to the number of chambers; the refilling means further comprising refill plugs corresponding to each refill hole; each refill plug further comprising an internal refill plug portion and an external refill plug portion; each refill plug further comprising an elevated ridge located on the external refill plug portion; each refill plug capable of being screwed into the corresponding refill hole using the elevated ridges.

8. The container of claim 1 further comprising a refilling means; the refilling means comprising refill holes corresponding to the number of chambers; the refilling means further comprising refill plugs corresponding to each refill hole; each refill plug further comprising an internal refill plug portion and an external refill plug portion; each refill plug further comprising an elevated ridge located on the external refill plug portion; each refill plug capable of being screwed into the corresponding refill hole using the elevated ridges; each elevated ridge being flush with a bottom surface of the bottle portion when in a closed plug position.

9. The container of claim 1 further comprising a refilling means; the refilling means comprising refill holes corresponding to the number of chambers; the refilling means further comprising refill plugs corresponding to each refill hole; each refill plug further comprising an internal refill plug portion and an external refill plug portion; each refill plug further comprising an elevated ridge located on the external refill plug portion; each refill plug capable of being screwed into the corresponding refill hole using the elevated ridges; the refilling means further comprising gaskets placed between each refill plug and the bottle portion; each elevated ridge being flush with a bottom surface of the bottle portion when in a closed plug position.

10. The container of claim 1 wherein the means for securing the cap portion to the bottle portion comprises a female coupling ring screwably affixed to a male threaded portion located on the external bottle portion; the container further comprising a refilling means; the refilling means comprising refill holes corresponding to the number of chambers; the refilling means further comprising refill plugs corresponding to each refill hole; each refill plug further comprising an internal refill plug portion and an external refill plug portion; each refill plug further comprising an elevated ridge located on the external refill plug portion; each refill plug capable of being screwed into the corresponding refill hole using the elevated ridges; each elevated ridge being flush with a bottom surface of the bottle portion when in a closed plug position.

11. The container of claim 1 further comprising a refilling means; the refilling means comprising refill holes corresponding to the number of chambers; the refilling means further comprising refill plugs corresponding to each refill hole; each refill plug further comprising an internal refill plug portion and an external refill plug portion; each refill plug further comprising an elevated ridge located on the external refill plug portion; each refill plug capable of being screwed into the corresponding refill hole using the elevated ridges; each elevated ridge being recessed in relation to a bottom surface of the bottle portion when in a closed plug position.

12. The container of claim 1 further comprising a refilling means; the refilling means comprising refill holes corresponding to the number of chambers; the refilling means further comprising refill plugs corresponding to each refill hole; each refill plug further comprising an internal refill plug portion and an external refill plug portion; each refill plug further comprising an elevated ridge located on the external refill plug portion; each refill plug capable of being screwed into the corresponding refill hole using the elevated ridges; the refilling means further comprising gaskets placed between each refill plug and the bottle portion; each elevated ridge being recessed in relation to a bottom surface of the bottle portion when in a closed plug position.

13. The container of claim 1 wherein the means for securing the cap portion to the bottle portion comprises a female coupling ring screwably affixed to a male threaded portion located on the external bottle portion; the container further comprising a refilling means; the refilling means comprising refill holes corresponding to the number of chambers; the refilling means further comprising refill plugs corresponding to each refill hole; each refill plug further comprising an internal refill plug portion and an external refill plug portion; each refill plug further comprising an elevated ridge located on the external refill plug portion; each refill plug capable of being screwed into the corresponding refill hole using the elevated ridges; each elevated ridge being recessed in relation to a bottom surface of the bottle portion when in a closed plug position.

* * * * *